US009132680B2

(12) United States Patent
Ikeda et al.

(10) Patent No.: US 9,132,680 B2
(45) Date of Patent: Sep. 15, 2015

(54) INKJET PRINTING APPARATUS AND CHECK PATTERN PRINTING METHOD

(71) Applicant: CANON KABUSHIKI KAISHA, Tokyo (JP)

(72) Inventors: Tohru Ikeda, Yokohama (JP); Akihiko Nakatani, Kawasaki (JP); Okinori Tsuchiya, Kawasaki (JP); Takashi Fujita, Kawasaki (JP); Hiromitsu Akiba, Yokohama (JP); Takeru Sasaki, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/325,629

(22) Filed: Jul. 8, 2014

(65) Prior Publication Data

US 2015/0015637 A1 Jan. 15, 2015

(30) Foreign Application Priority Data

Jul. 11, 2013 (JP) ..... 2013-145605

(51) Int. Cl.
*B41J 29/38* (2006.01)
*B41J 29/393* (2006.01)

(52) U.S. Cl.
CPC ..... *B41J 29/393* (2013.01)

(58) Field of Classification Search
USPC ..... 347/6, 14, 15, 17, 19, 37, 40, 41, 43
See application file for complete search history.

(56) References Cited

U.S. PATENT DOCUMENTS

| | | | | |
|---|---|---|---|---|
| 6,761,426 | B2 | 7/2004 | Tsuchiya et al. | |
| 2002/0158936 | A1 * | 10/2002 | Otsuka et al. | 347/19 |
| 2005/0275683 | A1 * | 12/2005 | Furuichi et al. | 347/35 |
| 2010/0207985 | A1 * | 8/2010 | Takahashi et al. | 347/14 |
| 2011/0249053 | A1 * | 10/2011 | Makita et al. | 347/17 |
| 2012/0081449 | A1 | 4/2012 | Kagawa et al. | |

FOREIGN PATENT DOCUMENTS

| | | | | |
|---|---|---|---|---|
| JP | 04128052 | A * | 4/1992 | B41J 2/205 |
| JP | 2007-313744 | A | 12/2007 | |
| JP | 2010-179532 | A | 8/2010 | |

* cited by examiner

*Primary Examiner* — Hai C Pham
(74) *Attorney, Agent, or Firm* — Fitzpatrick, Cella, Harper & Scinto

(57) ABSTRACT

A check pattern is printed which makes it possible to detect, with high precision, individual patterns corresponding to nozzles of a print head of an inkjet printing apparatus. More specifically, after an alignment mark is printed, ejection of an ink from the nozzles is stopped for a certain time. Because of this stoppage time, the concentration of a coloring material of the ink ejected from the nozzles increases, whereby the optical density of an analysis pattern which is printed later can be increased. In this manner, a scanner can read, with high precision, the patterns corresponding to the nozzles.

19 Claims, 15 Drawing Sheets

| | R | G | B |
|---|---|---|---|
| C INK | 0～10 | 245～255 | 245～255 |
| M INK | 245～255 | 0～10 | 245～255 |
| Y INK | 245～255 | 245～255 | 0～10 |
| K INK | 0～10 | 0～10 | 0～10 |

FIG.7

| FIG.12A | FIG.12B |
| --- | --- |

INKJET PRINTING APPARATUS AND CHECK PATTERN PRINTING METHOD

BACKGROUND OF THE INVENTION

1. Field of the Invention

The present invention relates to an inkjet printing apparatus and a check pattern printing method, and particularly relates to a technique of improving the detection accuracy of a check pattern for checking the predetermined characteristics of a printing apparatus.

2. Description of the Related Art

As this type of technique, Japanese Patent Laid-Open No. 2007-313744 discloses reading a test pattern as a plurality of divided images whose alignment marks overlap one another and obtaining primary coordinate data indicating, for each divided image, a print pattern corresponding to a print element based on one alignment mark and the position of the other alignment mark. The primary coordinate data is combined based on the overlapping alignment marks for the images, thereby obtaining secondary coordinates indicating the positions of the print patterns in the whole test pattern. Accordingly, Japanese Patent Laid-Open No. 2007-313744 discloses a checking and analyzing method capable of determining, with high precision, the relative positions of the print patterns in the whole test pattern.

However, in the technique disclosed in Japanese Patent Laid-Open No. 2007-313744, it is impossible to determine the positions of print patterns with high precision in a case where it is impossible to detect well an individual print patterns, in the first place. For example, in a case where the resolution of a reading optical system is not sufficiently high, it is impossible to clearly and distinctly detect individual patterns corresponding to nozzles of a print head, and accordingly, it is impossible to detect the positions of the patterns with high precision.

This problem may be solved by providing a reading optical system having high Modulation Transfer Function (MTF) or high SN sensitivity. However, this reading optical system produces a problem of increased cost.

SUMMARY OF THE INVENTION

An object of the present invention is to provide an inkjet printing apparatus and a check pattern printing method capable of printing check patterns such that the individual patterns corresponding to nozzles of a print head can be detected with high precision.

In a first aspect of the present invention, there is provided an inkjet printing apparatus comprising: a print head including a plurality of nozzles for ejecting an ink; and a printing control unit configured to perform printing of a first pattern and a second pattern by ejecting the ink to a printing medium from each of the plurality of nozzles of the print head while relatively moving the printing medium with respect to the print head, wherein the printing control unit performs printing of the first pattern and then performs printing of the second pattern after time, during which the ink is not ejected from the plurality of nozzles of the print head, elapses from printing of the first pattern, and wherein the temperature of the ink around an ejection opening of each of the plurality of nozzles is 50° C. or more for at least a predetermined time in the time during which the ink is not ejected.

In a second aspect of the present invention, there is provided a check pattern printing method comprising: a printing control step of printing a first pattern and a second pattern by ejecting an ink on a printing medium from each of a plurality of nozzles of a print head while relatively moving the printing medium with respect to the print head, wherein the printing control step prints the first pattern and then prints the second pattern after time, during which the ink is not ejected from the plurality of nozzles of the print head, elapses from printing of the first pattern, and wherein the temperature of the ink around an ejection opening of each of the plurality of nozzles is 50° C. or more for at least a predetermined time in the time during which the ink is not ejected.

In a third aspect of the present invention, there is provided a check pattern printing method comprising: a pattern printing step of printing an analysis pattern by ejecting an ink to a printing medium from each of a plurality of nozzles of a print head while relatively moving a printing medium with respect to the print head, and a reading step of reading the analysis pattern, wherein the pattern printing step prints the analysis pattern after time of 30 milliseconds, during which the ink is not ejected from the plurality of nozzles of the print head, elapses.

In the above configuration, it becomes possible to print a check pattern such that the individual patterns corresponding to the nozzles of the print head can be detected with high precision.

Further features of the present invention will become apparent from the following description of exemplary embodiments (with reference to the attached drawings).

BRIEF DESCRIPTION OF THE DRAWINGS

FIG. 7 is a diagram showing correspondence relationships between the values of R, G, and B and ink colors read from a start bar in a check pattern;

DESCRIPTION OF THE EMBODIMENTS

Embodiments of the present invention will be described in detail below with reference to the drawings.

Figure 1A:
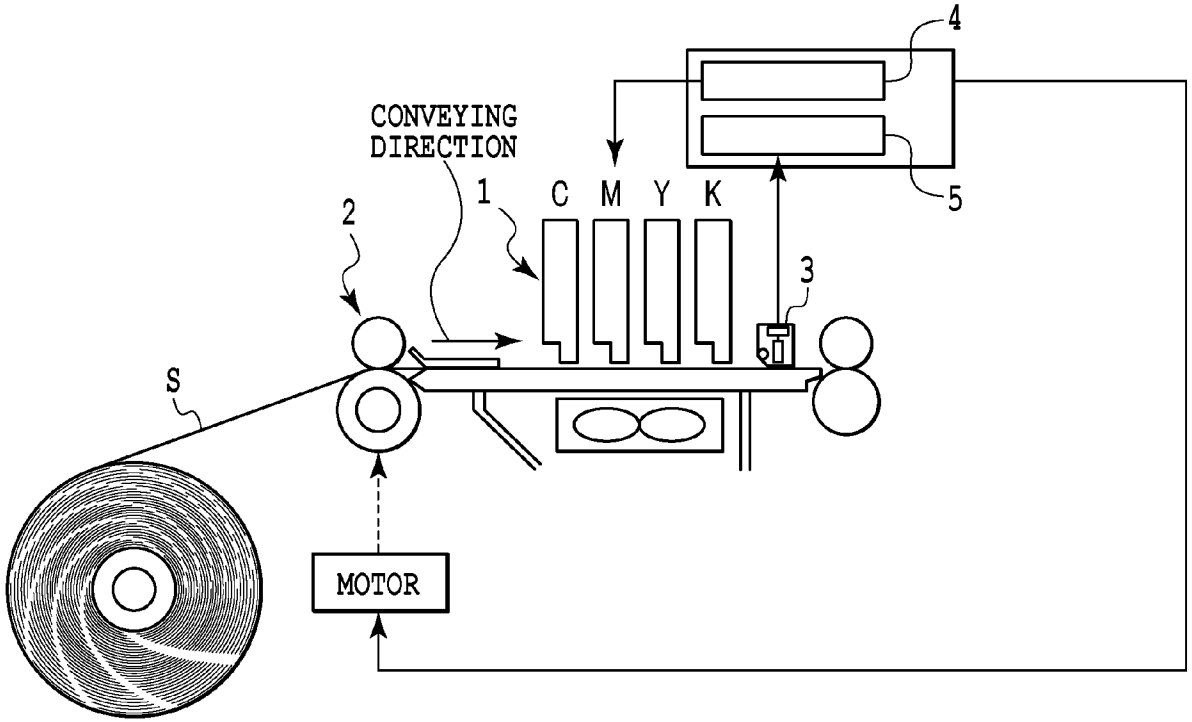
FIG. 1A is a diagram showing the schematic structure of an inkjet printing apparatus according to an embodiment of the present invention.

FIG. 1A is a diagram showing the schematic structure of an inkjet printing apparatus according to an embodiment of the present invention. In FIG. 1A, a conveyance roller 2 is rotated by driving a motor, whereby a printing medium S is conveyed. An ink is ejected on the printing medium S from a nozzle of a print head 1 to perform printing while the printing medium S is conveyed. In the present embodiment, the print head 1 is provided for each of cyan (C), magenta (M), yellow (Y), black (K), photo cyan (PC), photo magenta (PM), and photo black (PBk) inks (the print heads for the PC, PM, and PBk inks are not shown). The photo cyan (PC), photo magenta (PM), and photo black (PBk) inks have the concentrations of coloring materials such as dyes (hereinafter referred to as "the concentrations" of the coloring materials) lower than the C, M and Bk inks.

Figure 1B:
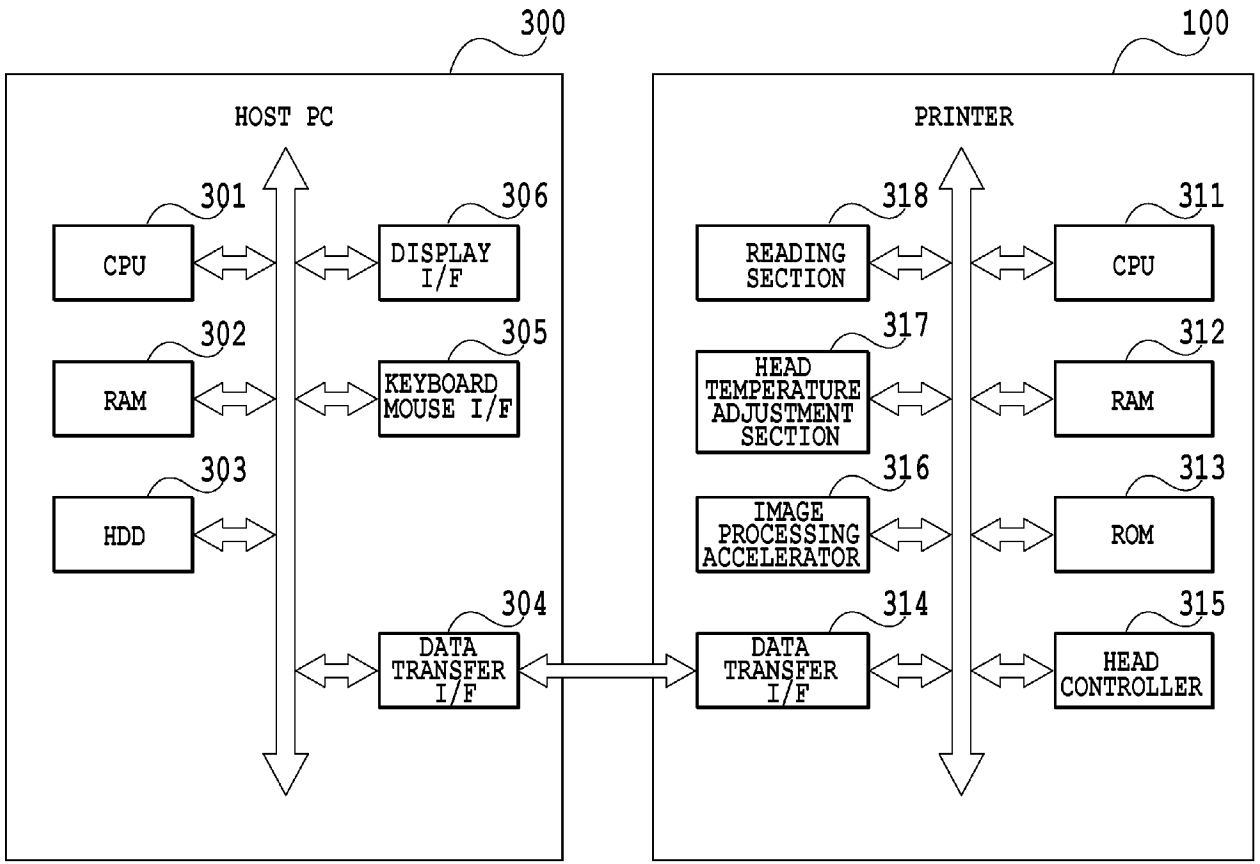
FIG. 1B is a block diagram showing a printing system according to one embodiment of the present invention.

FIG. 1B is a block diagram showing a printing system according to one embodiment of the present invention. As shown in FIG. 1B, this printing system comprises a printer 100 shown in FIG. 1A and a personal computer (PC) 300 as a host device for the printer.

The host PC 300 mainly comprises the following elements. A CPU 301 performs processing according to a program held in an HDD 303 or a RAM 302. The RAM 302 is a volatile storage and temporarily holds a program or data. The HDD 303 is a nonvolatile storage and also holds a program or data. In the present embodiment, MCS data specific to the present invention which will be described later is also stored in the HDD 303. A data transfer interface (I/F) 304 controls data transmission/reception between the printer 100 and the host PC 300. USB, IEEE 1394, LAN or the like can be used as a connection system for the data transmission/reception. A keyboard mouse I/F 305 is an I/F for controlling a Human Interface Device (HID) such as a keyboard or a mouse, and a user can input data via this I/F. A display I/F 306 controls the display operation of a display (not shown).

Further, the printer 100 mainly comprises the following elements. A CPU 311 performs processing which will be described later according to a program held in a ROM 313 or a RAM 312. The RAM 312 is a volatile storage and temporarily holds a program or data. The ROM 313 is a nonvolatile storage and can hold table data or a program to be used for processing which will be described later.

A data transfer I/F 314 controls data transmission/reception between the printer 100 and the host PC 300. A head controller 315 supplies print data to print heads 101 to 104 shown in FIG. 1A and functions as a printing control unit configured to control the ejection operations of the print heads. More specifically, the head controller 315 can be configured to read a control parameter and print data from a predetermined address of the RAM 312. In a case where the CPU 311 writes a control parameter and print data to the predetermined address of the RAM 312, the head controller 315 activates processing to eject inks from the print heads.

The CPU 311 controls a temperature adjustment section 317 to control the temperatures of the heads or the inks to be supplied to the heads. Whether to use heating by a heater, cooling by a chiller, or both is determined according to the system of the embodiment. Further, in the case of a thermal inkjet system, heat used for bubble generation may be used. In this case, the temperature adjustment section 317 may be omitted.

The reading section 318 controls a scanner 3 shown in FIG. 1A and analyzes data on a read image according to a chart which will be described later.

Figure 2A:
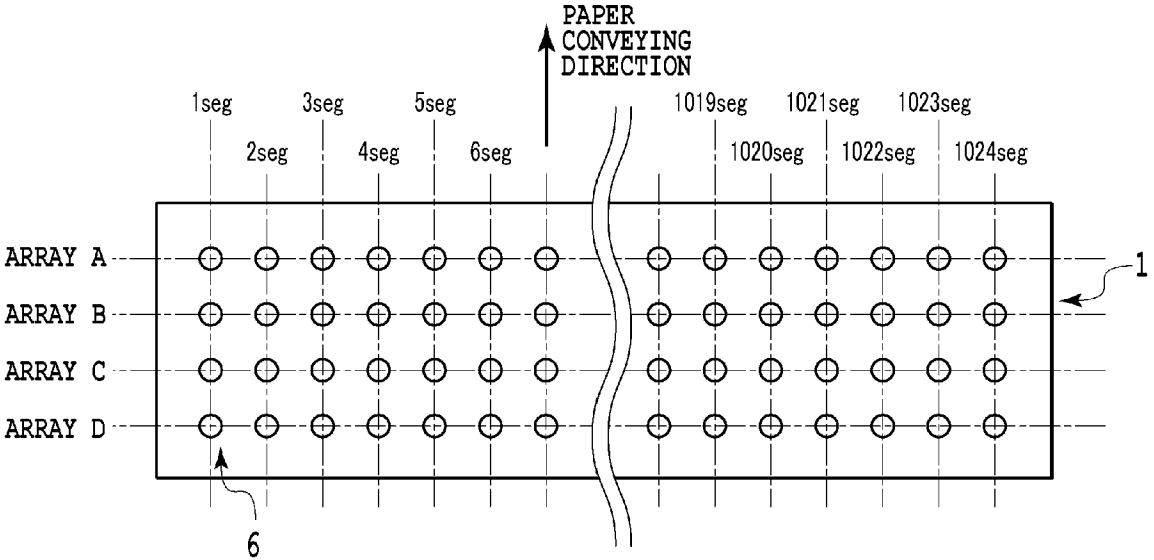
FIG. 2A is a diagram showing the nozzle arrangement of a print head shown in FIG. 1A.

FIG. 2A is a diagram showing the nozzle arrangement of the print head shown in FIG. 1A and showing the nozzle arrangement of the print head 1 for one color. As shown in FIG. 2A, four arrays (arrays A, B, C, D) of 1024 nozzles for each color are arranged in a paper conveying (relative movement) direction. A nozzle arrangement density in each array is 1200 dpi. The temperature of an ink ejected by this print head can be controlled by a temperature controller. Further, in an ejection method for the print head of the present embodiment, the ink is heated rapidly to cause film boiling and ejected by using the pressure of a bubble generated by the film boiling. In this case, the ink in the print head can be kept at a constant temperature by thermally insulating the ink with air or a heat insulating material. Further, the temperature of the ink in the print head is controlled or balanced, whereby it is possible to control and stabilize physical properties such as the viscosity and surface tension of the ink and ink ejection characteristics such as an ejection speed, an ejection ink drop size, and a satellite produced by the breaking ink or the like.

Figure 2B:
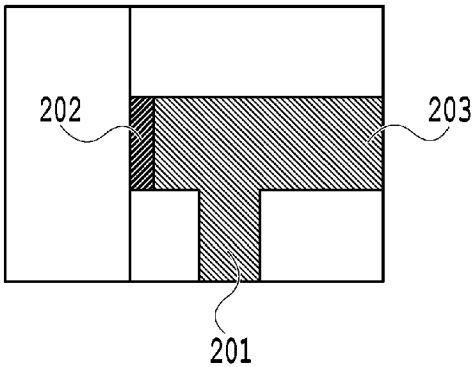
FIG. 2B is a view of the print head seen from a cross-sectional direction.

FIG. 2B is a view of the print head seen from a cross-sectional direction. The ink supplied from an ink supply path 201 is heated by a heater 202 to generate a bubble and is ejected from an ejection opening 203. Incidentally, the term "ink temperature" in the present specification means the temperature of the ink around the ejection opening. It should be noted that, in a case where the temperature of the ink is substantially equal to the temperature of the head, the detected temperature of the head may be used as the temperature of the ink. A temperature detection circuit built in a print head detects the temperature of the head. It should be noted that the schematic diagram shows an example of the inkjet system, and another structure may be used. Further, a method for ejecting an ink is not limited to the one using a heater, and a piezo ejection method may be used, for example.

The above printing apparatus performs printing of a check pattern for detecting ejection failure of a nozzle of the print head, performs reading of the check pattern with the scanner 3 (FIG. 1A), and performs detecting ejection failure of a nozzle by analyzing a reading result. A printing control section 4 controls printing of the check pattern and a scanner control section 5 (FIG. 1A) analyzes the check pattern.

Figure 3:
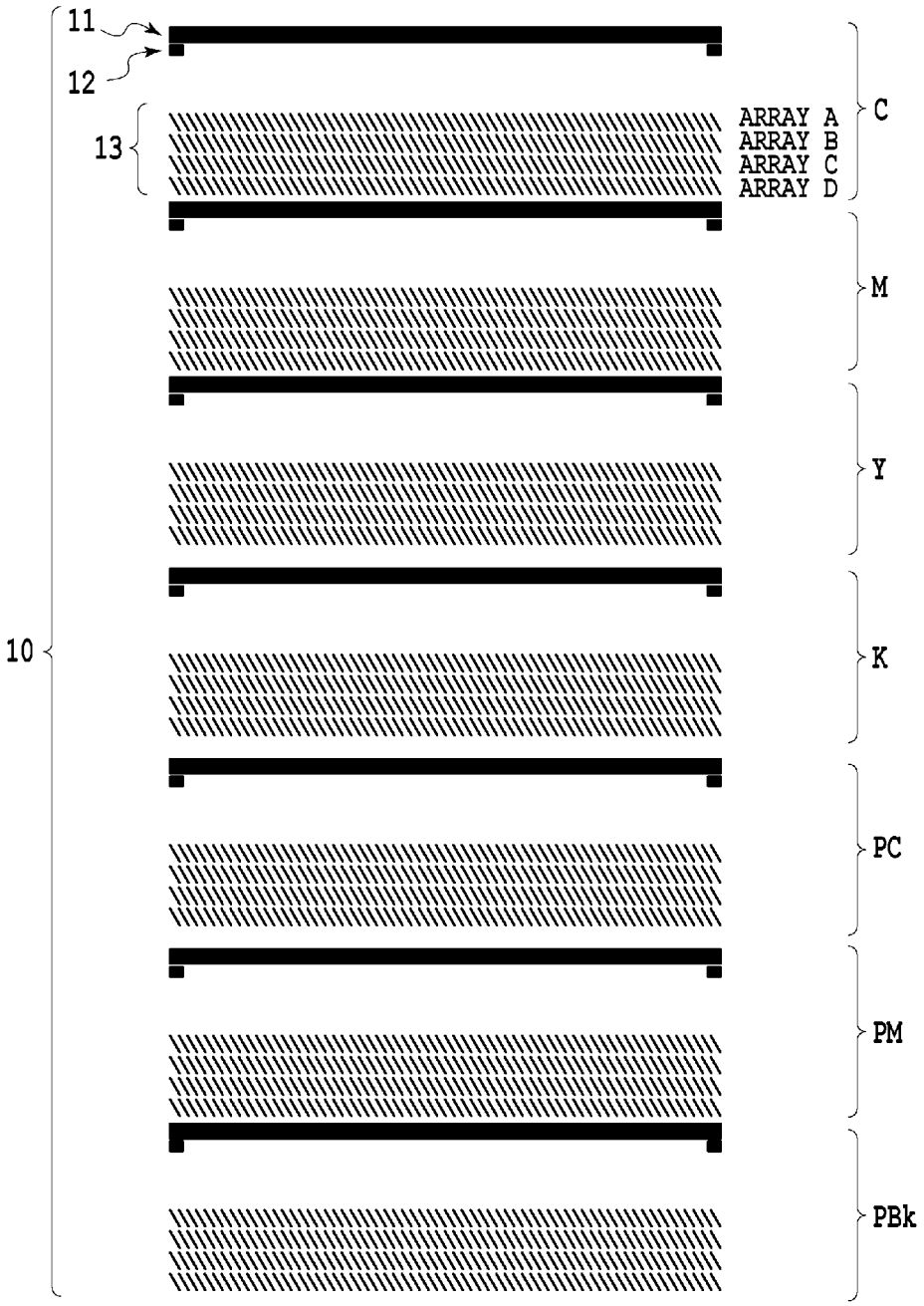
FIG. 3 is a diagram showing a check pattern according to an embodiment of the present invention.

FIG. 3 is a diagram showing a check pattern according to an embodiment of the present invention. The check pattern is used to detect an ejection failure in a nozzle. In FIG. 3, the check pattern 10 includes a start bar 11, an alignment mark 12, and an analysis pattern 13, for each ink color. The start bar 11 is a pattern for identifying R/G/B analysis channels in the case of performing pattern analysis. The alignment mark 12 is a mark serving as a reference for identifying an analysis position and is printed by using a plurality of nozzle arrays arranged in a sheet conveying direction. The analysis pattern 13 is printed to correspond to the individual nozzles of the print head and printed with the individual nozzles to correspond to the nozzle arrays A, B, C, and D. Such combinations of patterns for respective colors are arranged from an upper portion of FIG. 3 in the order of the C, M, Y, K, PC, PM, and PBk inks and printed in this order.

Figure 4A:
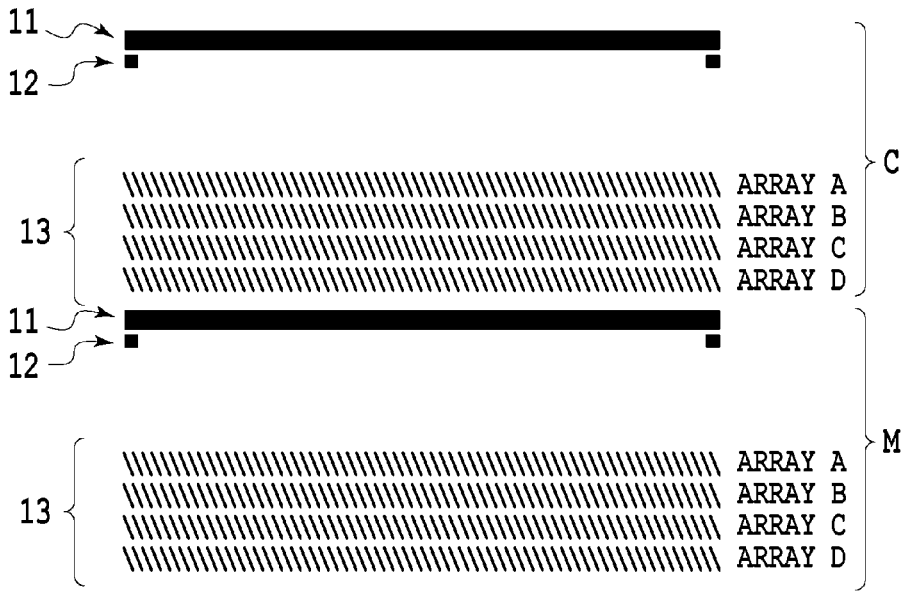
FIGS. 4A and 4B are enlarged diagrams of part of the check pattern 10 shown in FIG. 3.
Figure 4B:
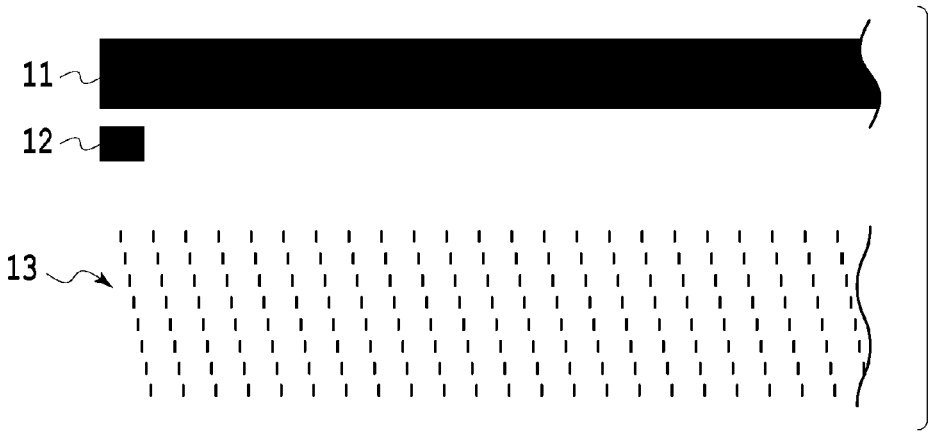

FIGS. 4A and 4B are enlarged diagrams of part of the check pattern 10 shown in FIG. 3. As shown in FIGS. 4A and 4B, after the start bar 11 and the alignment mark 12 are printed, ejection is not performed for a predetermined time, and thereafter the analysis pattern 13 is printed. In this manner, a white portion whose length corresponds to the conveying speed of a printing medium and whose color is the original color of the printing medium is formed between the analysis pattern 13 and the alignment mark 12. Further, as described later, the non-ejection predetermined time increases the optical density (hereinafter referred to as the optical density or merely referred to as "the density") of the analysis pattern 13 corresponding to each nozzle, whereby it becomes possible to read, with high precision, the pattern itself corresponding to each nozzle by using a scanner.

Figure 5:
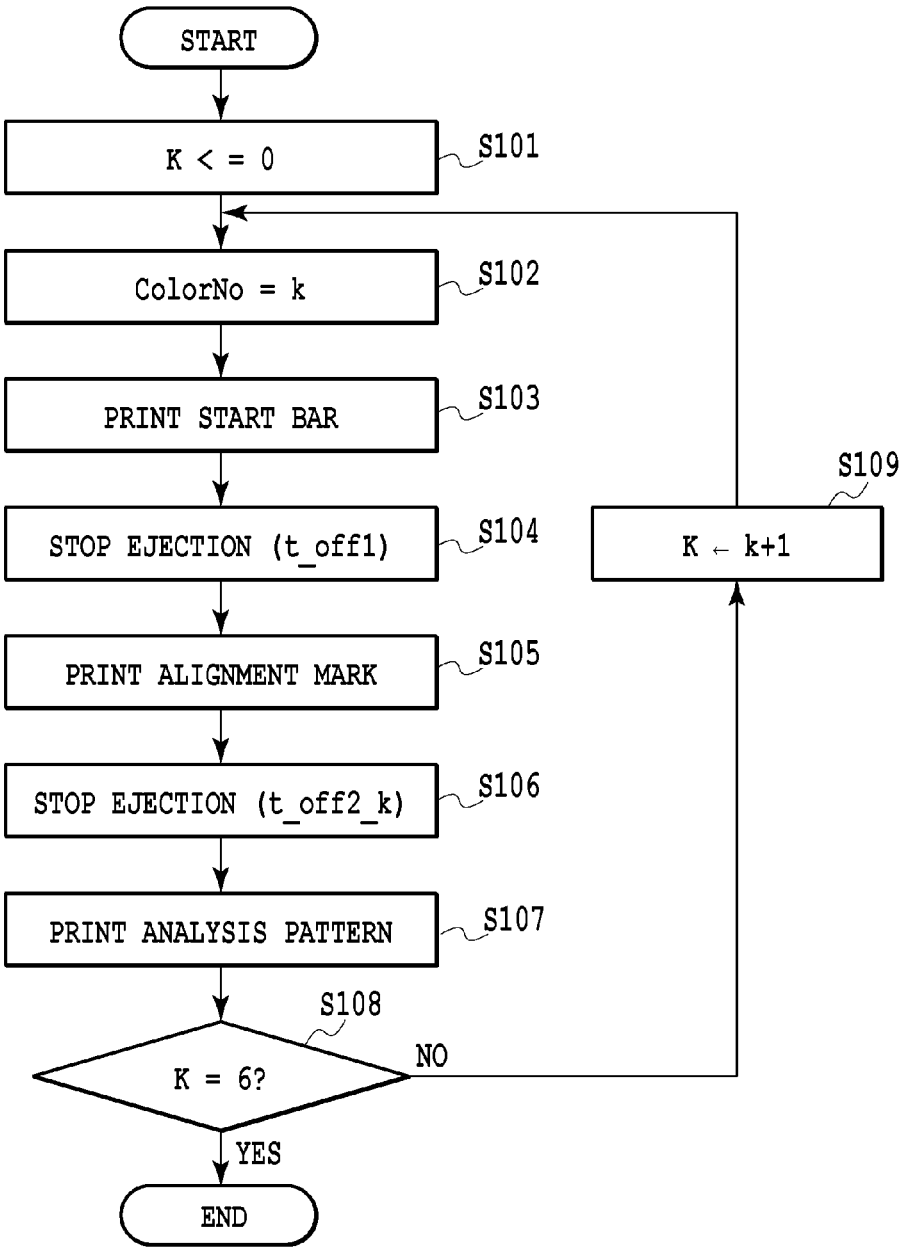
FIG. 5 is a flowchart for processing for printing a check pattern according to an embodiment of the present invention.

FIG. 5 is a flowchart of print processing for a check pattern, according to an embodiment of the present invention. In the present processing, first, parameters and the like are initialized (S101). Color parameters for a check pattern to be printed are set (S102). In the present embodiment, the check pattern is printed by the print heads for the seven colors and the following processing is repeated for the seven colors. In this processing, the start bar 11 is first printed (S103). Next, before the alignment mark 12 is printed, a time (t_off1) in which ink ejection from the print heads is stopped (S104) is taken. After the time elapses, the alignment mark 12 is printed (S105). The ejection stoppage time (t_off1) is determined in consideration of a length sufficient for detecting the start bar and the alignment mark and the type of printing medium such as paper to be used. During the stoppage time, the printing medium S on which a check pattern is to be printed is conveyed at a predetermined speed, a white portion is formed between the start bar 11 and the alignment mark 12.

Next, after the alignment mark 12 is printed, ink ejection from the nozzles is stopped for a certain time (t_off2) (S106). As described later, the concentration of the coloring material of an ink droplet ejected from each nozzle increases because water around the ejection opening of each nozzle evaporates for the stoppage time t_off2. This makes it possible to increase the optical density of the analysis pattern to be printed later. In the present embodiment, the time t_off2 is set at 30 milliseconds. However, the time t_off2 may be set at 30 milliseconds or more (200 milliseconds, for example) according to the temperature of the ink to be ejected. In order to increase the concentration of the coloring material of the ejected ink droplet, it is necessary that the temperature of the ink around the ejection opening be equal to or greater than a predetermined value during the certain period (t_off2) in which the ink is not ejected. In the present embodiment, after the alignment mark 12 is printed, a temperature around the ejection opening is kept at 50° C. or more for at least 30 milliseconds to increase the concentration of the coloring material in the ink.

After ejection is stopped for the predetermined time (t_off2), the analysis pattern 13 is printed by ejecting the ink from each nozzle (S107). The above processing is repeated for the seven colors (S108 and S109). In the present embodiment, basically, the stoppage time t_off2 is set for each ink color and for each print head. The setting of the stoppage time t_off2 will be described later in the examples in detail.

Figure 6:
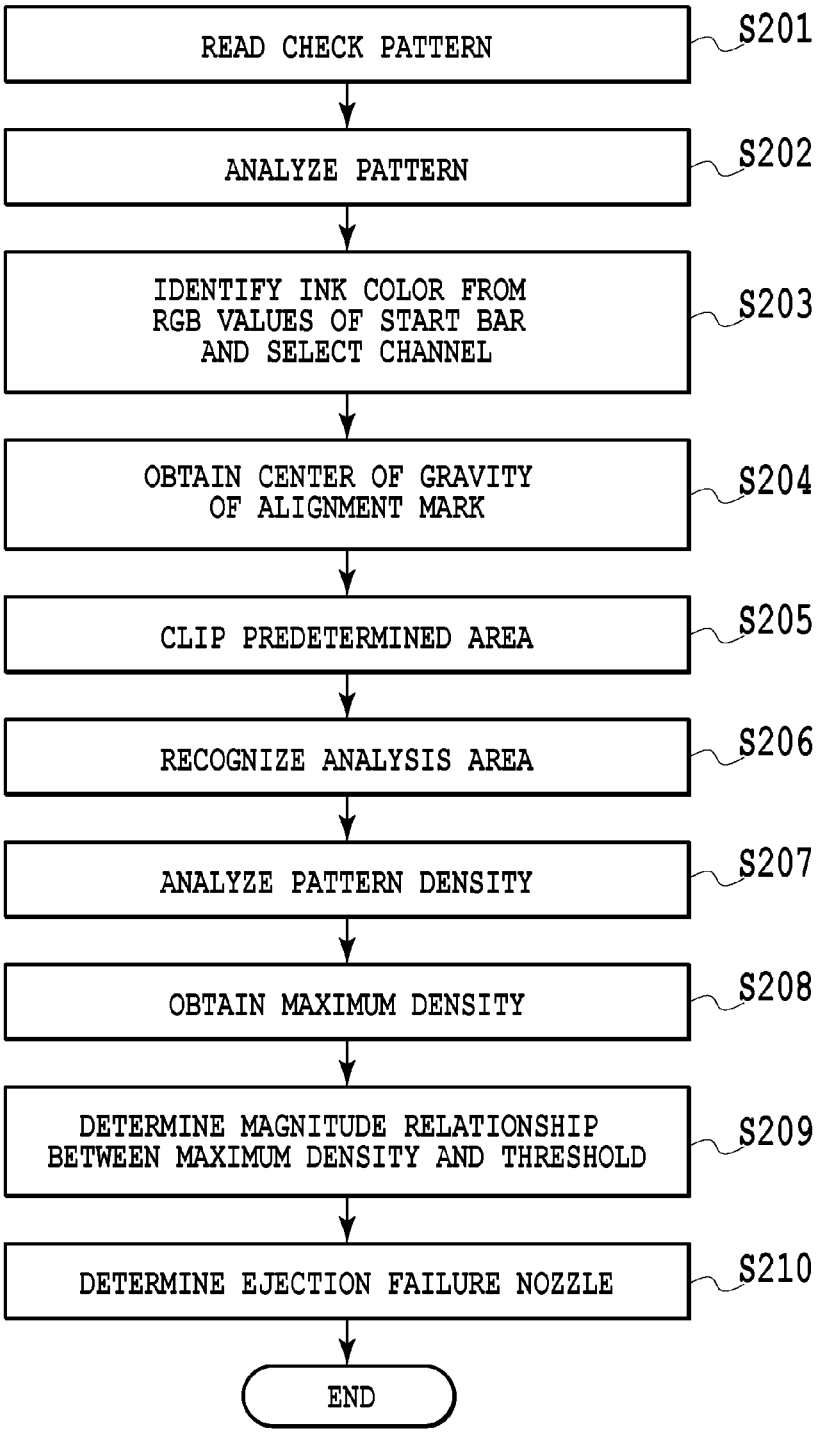
FIG. 6 is a flowchart for check pattern analysis processing for detecting an ejection failure nozzle according to an embodiment of the present invention.

FIG. 6 is a flowchart for check pattern analysis processing for detecting an ejection failure nozzle, according to the present embodiment. First, reading of the check pattern is performed using the scanner 3 (S201). The reading resolution is 1200 dpi. The scanner control section 5 analyzes the read check pattern (S202). In this analysis, an ink color is identified from the values of R, G, and B read from the start bar 11, and it is determined which of the R, G, and B channels is to be analyzed (S203). In a case where a print head for each ink color is independent as in the present embodiment, mechanical position accuracy in mounting the print head produces effects. In order to reduce the effects, the start bar 11 can be provided for each ink color to improve the accuracy. FIG. 7 is a diagram showing correspondence relationships between the values of R, G, and B and ink colors and shows only a part of the inks.

Figure 8:
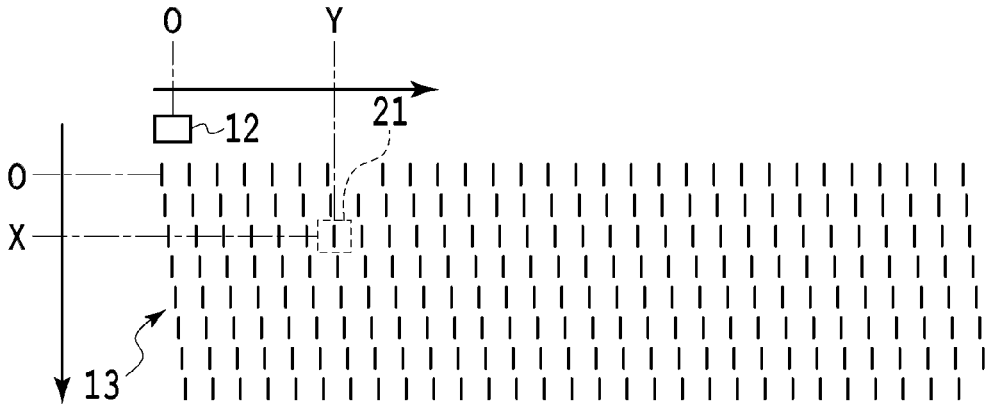
FIG. 8 is a diagram for explaining processing for recognizing an analysis area in a check pattern.

Next, the position of the center of gravity of the alignment mark 12 is obtained (S204). Next, a predetermined area of the analysis pattern is clipped (S205). In the clipped predetermined area, an analysis area corresponding to each nozzle is recognized by using, as a reference, the obtained center of gravity of the alignment mark (S206). FIG. 8 is a diagram for explaining processing for recognizing an analysis area. As shown in FIG. 8, the position of an analysis area 21 of the analysis pattern is obtained in the form of the coordinates of the number of pixels X from the end of the analysis pattern and the number of pixels Y from the position of the center of gravity of the alignment mark 12.

Figure 9A:
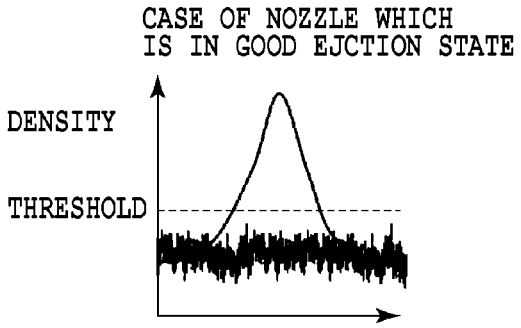
FIGS. 9A to 9D are diagrams showing a relationship between an analyzed density and a nozzle ejection state.
Figure 9B:
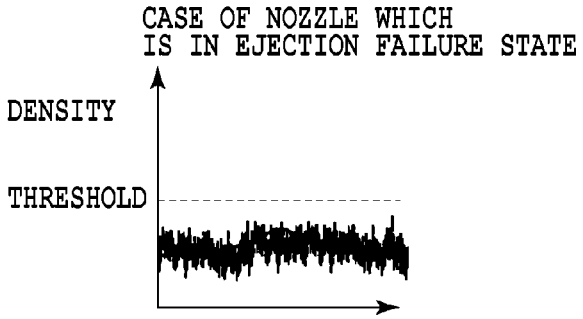

Next, the density of the pattern in the analysis area is analyzed (S207). FIGS. 9A to 9D are diagrams showing a relationship between an analyzed density and a nozzle ejection state. The horizontal axis represents an area in which a pattern extends, and the vertical axis represents a density as an analysis result. As shown in FIG. 9A, in a case where a maximum pattern density is higher than a predetermined threshold, it is determined that a nozzle corresponding to the analysis area is in a good ejection state. On the other hand, as shown in FIG. 9B, in a case where the maximum pattern density is lower than the threshold, it is determined that the nozzle corresponding to the analysis area is in an ejection failure state.

Figure 9C:
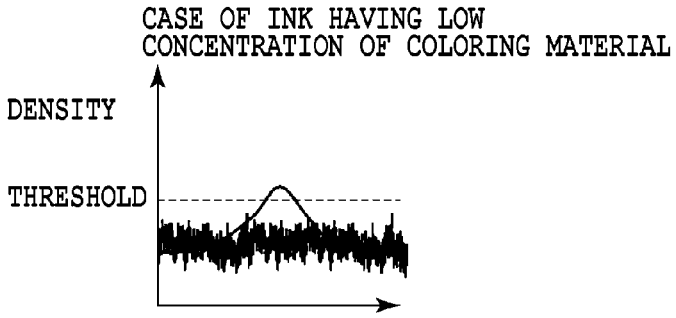

It should be noted that, in a case where the ink has the low concentration of the coloring material, as shown in FIG. 9C, for example, the level of an entire signal becomes low. A CCD or C-MOS sensor, which is generally used for reading, produces random noise referred to as light shot noise in the case of performing photoelectric conversion. On the other hand, the effects of the noise can be reduced by using an element whose number of conversions is large, but in order to realize necessary resolution, a high-sensitive expensive element is required. The light shot noise is random noise, and accordingly, in a case where data obtained by a plurality of reading operations is accumulated, SN sensitivity tends to become high. Accordingly, data for five lines, for example, can be added, but the number of lines can be changed according to a light receiving element and a detection signal value. However, a noise component can be reduced according to the square root of the number of used samples, and accordingly, the number of samples needs to be increased according to the square of the amount of reduction, and a larger amount of paper is consumed for a check and this is not preferable.

Figure 9D:
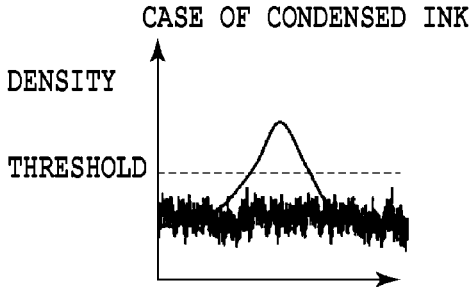

FIG. 9D shows an example of the case of increasing the optical density of the analysis pattern by condensing the inks of each of the colors around the ejection openings of the nozzles and increasing the concentration of the coloring materials to print the analysis pattern, according to an embodiment of the present invention which will be described below.

The evaporation amount of water is proportional to a difference between a steam pressure in the air and a steam pressure in saturated air whose temperature is equal to a water temperature. The steam pressure of the saturated air rises as the temperature rises. While the ink is not ejected from any nozzle of the print head, the ink is not newly supplied, and since a solvent in the ink continues to evaporate, the ink is condensed.

Figure 10A:
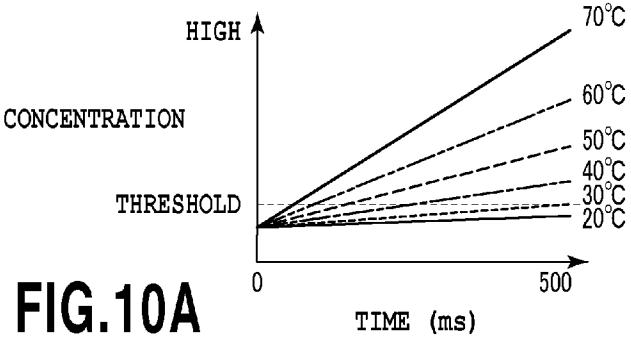
FIGS. 10A to 10D are diagrams showing a relationship between an ejection stoppage time and the concentration of a condensed coloring material in an ink at the time of printing a check pattern according to an embodiment of the present invention.

FIG. 10A shows an example of a relationship between the ejection stoppage time for the nozzles of the print head according to the present embodiment and the concentration of coloring material in the condensed ink. The above ejection stoppage time t_off2 between printing of the alignment mark 12 and printing of the analysis pattern 13 is determined based on the above relationship. In FIG. 10A, a broken line indicates the threshold of the concentration of the coloring material which needs to be exceeded for detection by the scanner 3 used in the present embodiment. On the other hand, a solid line and the like show that in a case where the temperature of the print head is controlled whereby the temperature of the ink to be ejected is set at 20° C., 30° C., 40° C., 50° C., 60° C., or 70° C., as the stoppage time becomes longer, the concentration of the coloring material of the ink becomes higher.

The above-described ejection stoppage time t_off2 from printing of the alignment mark 12 to printing of the analysis pattern 13 is determined based on the relationship shown in FIG. 10A. In the present embodiment, in a case where the relationship shown in FIG. 10A is established, the stoppage time t_off2 is firstly determined as a time for enabling the concentration of the coloring material of the ink to exceed the threshold of the concentration of the coloring material. In this connection, in a case where the stoppage time t_off2 is too long, since the check pattern is printed on a sheet which is being conveyed, the length of a white portion of the check pattern between the alignment mark 12 and the analysis pattern 13 becomes larger and a wasteful portion of the sheet is created. Accordingly, it is desirable to set the temperature so as to increase the concentration of the coloring material so that the white portion is not long. In the present embodiment, the temperature is set at 50° C. or more. It should be noted that, needless to say, the stoppage time of the present embodiment is not long enough to thicken the ink and cause ejection failure.

FIG. 9D shows a case where the check pattern is printed with the ink whose concentration of the coloring material is increased because of the stoppage time determined in the above manner in the present embodiment, whereby the optical density of the check pattern becomes high and exceeds the density threshold as required by the scanner 3 for detection.

Several examples of determining the stoppage time of the present embodiment will be described below.

Example 1

The present example is an example of setting the ink temperature and the stoppage time for the PC ink which realizes the optical density (OD) of the printed pattern of 1.03, the PM ink which realizes the OD of 0.84, and the PBk ink which realizes the OD of 1.04. In the case of reading with a scanner having the MTF of 70%, the check pattern of the PM ink which realizes the lowest optical density OD of 0.84 among the above inks, the following are examples of the ink temperature and the stoppage time which realize the optical density exceeding the density threshold. The density of the read pattern is obtained from a G signal of the scanner. The ink temperature is set at 50° C. and the stoppage time t_off2 is set at 200 milliseconds based on the relationship shown in FIG. 10A.

In this setting, all the inks other than the PM ink realize the optical density exceeding the density threshold because of the above set stoppage time, and the common stoppage time can be set for all the inks, whereby it can make the control easy.

It should be noted that explanation has been made by taking, as an example, a scanner-read value having spectral characteristics in which sensitivity is high for a color complementary to an ink color. However, since the spectral characteristics of an ink and the spectral characteristics of a scanner determine sensitivity, signals of a plurality of R, G, and B channels may be processed and used.

Further, a print medium is conveyed intermittently in a serial printing apparatus which performs scanning by a print head to the printing medium to perform printing. Accordingly, conveyance of the printing medium can be stopped during the above-described ejection stoppage time. In this manner, an unnecessary portion such as a white portion is not created in a check pattern and this makes it possible to reduce the amount of paper used for printing the check pattern.

Example 2

In the case of the ink and the scanner shown in Example 1, a check pattern whose density exceeds the density threshold can also be printed by setting the ink temperature at 70° C. and setting the stoppage time t_off2 at 30 milliseconds based on the relationship shown in FIG. 10A.

Example 3

Figure 10B:
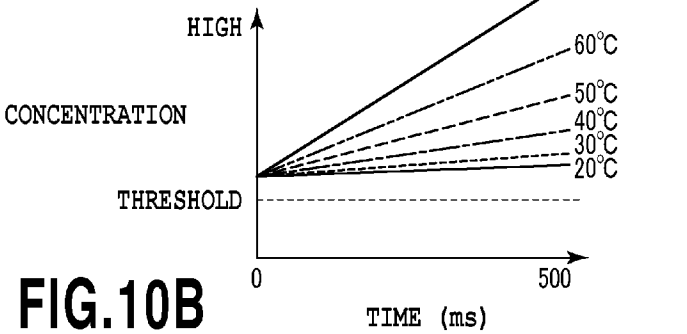

This example is an example of setting the ink temperature and the stoppage time for the Bk, C, M, and Y inks. In the case of the Bk ink which realizes the optical density OD of the printed pattern of 2.40, the C ink which realizes the OD of 2.53, the M ink which realizes the OD of 2.26, and the Y ink which realizes the OD of 2.07, the relationship between the stoppage time and the concentration of the coloring material for each ink temperature becomes the one shown in FIG. 10B. In this connection, a broken line in FIG. 10B shows the threshold of the concentration of the coloring material. As is clear from FIG. 10B, in the case of the Bk, C, M and Y inks, the concentration of the coloring material exceeds the threshold of the concentration of the coloring material whatever the stoppage time, and there is no need to provide the stoppage time. Accordingly, in the case of the above inks, it is possible to print the check pattern under a condition in which the amount of paper used for printing the check pattern is at minimum.

Figures 11A, 11B, 11C:
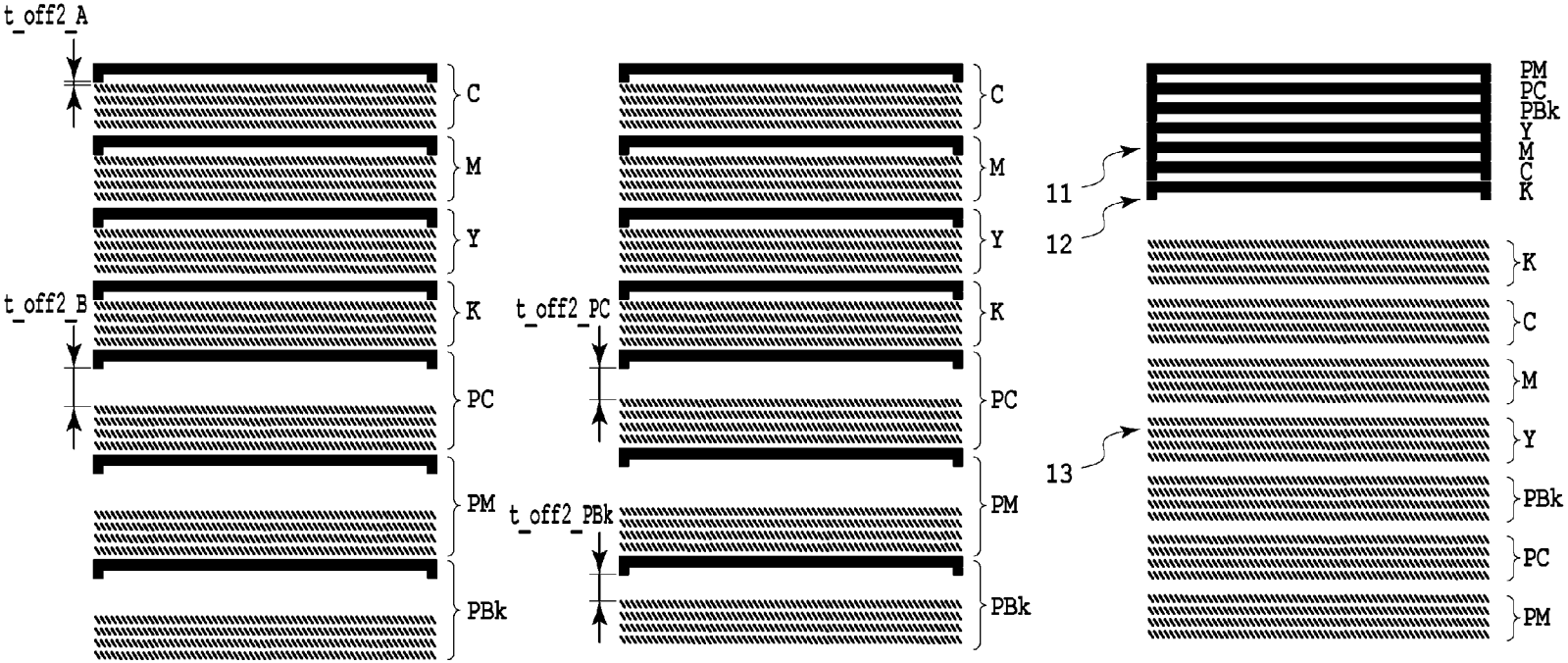
FIGS. 11A to 11C are diagrams showing, in particular, a white portion of a check pattern created by an ejection stop time according to an embodiment of the present invention.

FIG. 11A shows an example of printing a check pattern with the stoppage time set in Example 3. An ejection stoppage time t_off2_A relating to the Bk, C, M and Y inks can be set to zero, for example. Further, a stoppage time t_off2_B relating to the PC, PM and PBk inks can be set as described in Examples 1 and 2 above. More specifically, as shown in FIG. 11A, the stoppage time t_off2_B is set to be longer than the stoppage time t_off2_A.

Example 4

In this example, at least one of an ejection stoppage time t_off2_PC for the PC ink, a stoppage time t_off2_PM for the PM ink, and a stoppage time t_off2_PBk for the PBk ink is different from the others.

In order to print the analysis pattern of the PC ink whose concentration of the coloring material exceeds the threshold of the concentration of the coloring material shown by the broken line in FIG. 10A, for example, and whose optical density OD is 1.03, the stoppage time is 100 milliseconds in a case where the ink temperature is 50° C. In this manner, the ink temperature and the stoppage time can be determined according to the realizable optical density OD which corresponds to the color or type of the ink. This can prevent an unnecessary white portion from being created in a case where the check pattern is printed on a printing medium and can reduce a time for printing the pattern and the amount of the used printing medium.

FIG. 11B shows an example of printing the check pattern of the present example. As shown in FIG. 11B, the ejection stoppage time t_off2_PC for the PC ink is shorter than the stoppage time t_off2_PBk for the PBk ink.

FIG. 11C shows another example of the check pattern. As shown in FIG. 11C, the start bar 11 and the alignment mark 12 are not paired with the analysis pattern 13 for each color. In this case, as the optical density of the ink pattern detected by the scanner becomes lower, the ink pattern is printed later (in a lower portion of FIG. 11C). Accordingly, as the detected optical density for the ink becomes lower, the longer ejection stoppage time can be taken, and the concentration of the coloring material of the ink can be increased without creating a white portion.

As shown in FIG. 11C, the order of the inks for printing the start bar 11 (and the alignment mark 12) (the order from an upper portion of FIG. 11C to a lower portion thereof (the same can be said for descriptions below)) is reverse to the order of the inks for printing the analysis pattern. As the optical density for the ink detected by the scanner tends to become lower, the ejection stoppage time can be made longer. More specifically, during the stoppage time (t_off2_PM) for the PM ink, the start bar and the analysis pattern for the PC ink are printed, and during the stoppage time (t_off2_PC) for the PC ink, the start bar and the analysis pattern for the PBk ink are printed.

Figures 12, 12A:
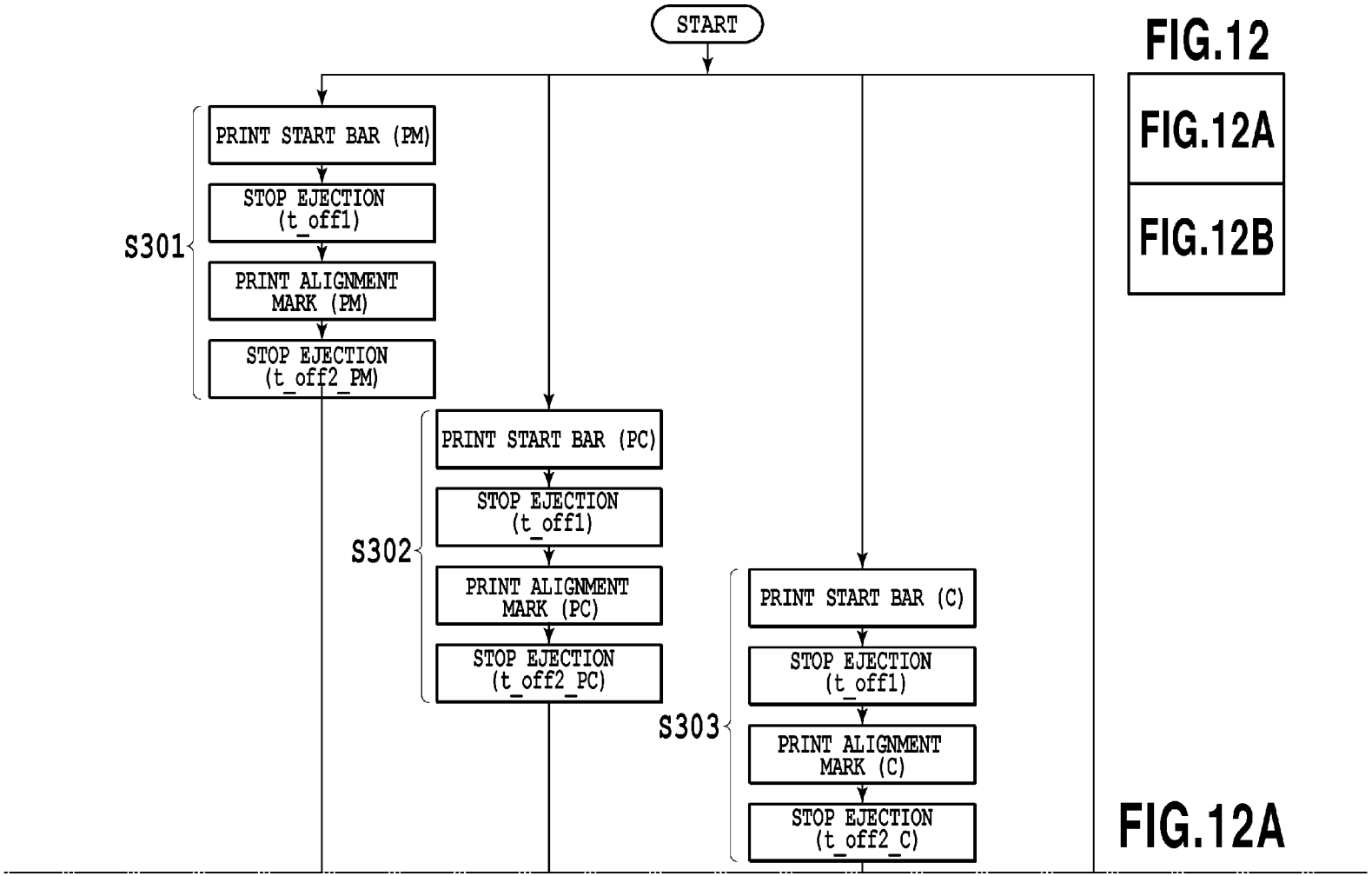
FIG. 12 is a diagram showing a relationship between FIG. 12A and FIG. 12B, and FIGS. 12A and 12B are flowcharts for processing for printing a check pattern according to an embodiment of the present invention.
Figure 12B:
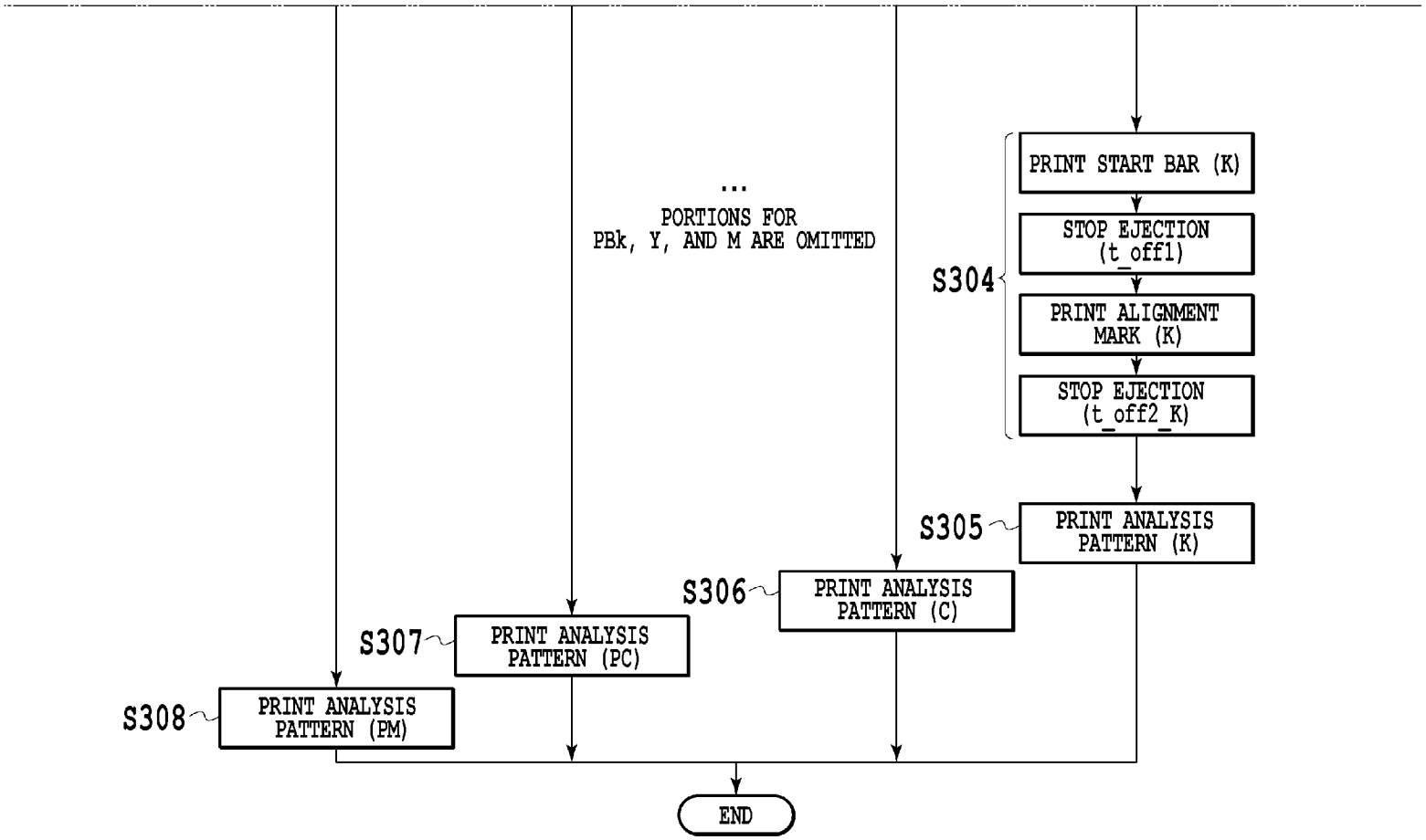

FIGS. 12A and 12B are flowcharts for print processing of this check pattern. The steps of this processing are performed in the order from an upper portion of FIGS. 12A and 12B to a lower portion thereof. More specifically, in step 301 for the PM ink, the start bar is printed, ejection is stopped during the stoppage time (t_off1), the alignment mark is printed, and ejection is stopped during the stoppage time (t_off2_PM). Next, in step 302, similar steps for the PC ink are performed. Similarly, in steps for the PBk, Y, M, C, and K inks, the start bar is printed, ejection is stopped during the stoppage time (t_off1), the alignment mark is printed, and ejection is stopped during the stoppage time (t_off2_PM). Thereafter, in step 305, the analysis pattern for the K ink is printed. Then, similarly, the analysis pattern is printed in the order of the C, M, Y, PBk, PC and PM inks (S307 and S308). In the above steps, the check pattern shown in FIG. 11C can be printed, and as the optical density detected by the scanner tends to become lower, the longer ejection stoppage time can be taken.

Example 5

In this example, firstly, the optical density of the analysis pattern which can be satisfactorily detected by the scanner is determined, and the ejection stoppage time is determined such that the area of a white portion becomes as small as possible. Further, in this example, the temperature of the ink to be ejected is set based on the relationship shown in FIG. 10C, for example and temperature control therefor is performed. In this case, a saturation temperature can be controlled by performing temperature control or an equilibrium temperature can be controlled by changing the thickness or material of a heat insulation material. In this example, the check pattern shown in FIG. 3 is obtained.

Figure 10C:
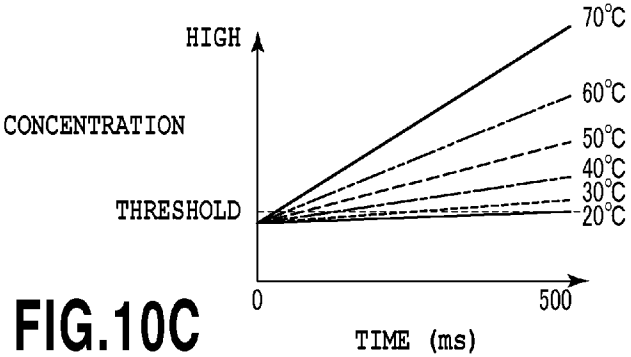
Figure 10D:
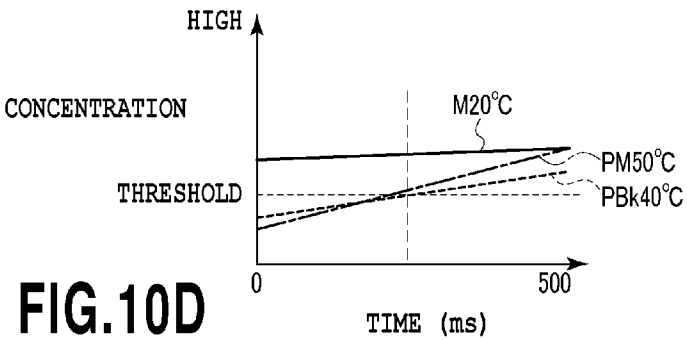

FIG. 10D shows another example of setting of the ink temperature (the temperature of the print head) which has been described with reference to FIG. 10C and explains an example of setting the ink temperature for each color ink. As shown in FIG. 10D, firstly, the optical density of the analysis pattern which can be satisfactorily detected by the scanner is determined. The temperature to be controlled is set for each ink according to the determined optical density. In the example shown in FIG. 10D, the temperature of the M ink is set at 20° C., the temperature of the PM ink is set at 50° C., and the temperature of the PBk ink is set at 40° C. Their stoppage times are set according to their respective temperatures.

It should be noted that, in a case where a plurality of line reading signals are used to perform processing, calculation may be performed by using reading line data. In the case of a random noise signal, for example, a variance value is reduced by performing addition, but it is possible to use the characteristics that a state of high ink dot density is changed to a normal state by printing a certain number of dots.

Further, in a case where the ejection stoppage time is long and reaches the order of several tens of millimeters, condensation occurs, thereby increasing viscosity and causing ejection failure, kogation, or the like. Accordingly, the upper limit of the ejection stoppage time may be set, and if necessary, preliminary ejection may be performed. This preliminary ejection may be performed at the time of printing the start bar.

The above examples have been explained by taking, as an example, a case where the scanner reads the ink whose concentration of the coloring material is low and a SN ratio is low. However, in a case where the ink has the same concentration of the coloring material and the size of a dot to be printed is small, the SN ratio becomes low because of the effects of the MTF of the scanner. In the case of using a photo cyan (SPC) ink for printing a dot smaller than a dot of the PC ink, the higher concentration of the coloring material can be realized by relatively lengthening the stoppage time, whereby it is possible to detect the pattern with high precision. Also in the case of using a photo magenta (SPM) ink for printing a dot smaller than a dot of the PM ink and a photo black (SPBk) ink for printing a dot smaller than a dot of the PBk ink, the higher concentration of the coloring material can be realized by relatively lengthening the stoppage time, whereby it is possible to detect the pattern with high precision.

Figure 13C:
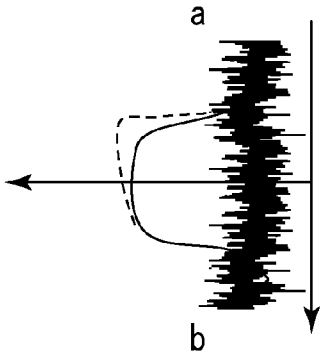
FIGS. 13A to 13C are diagrams showing an example to which the present invention is applied in a case where an edge portion is detected.
Figure 13B:
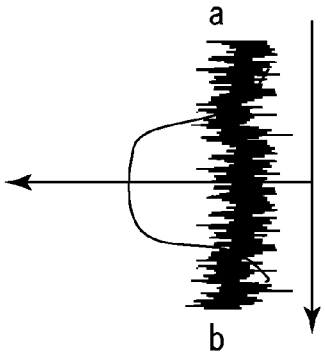
Figure 13A:
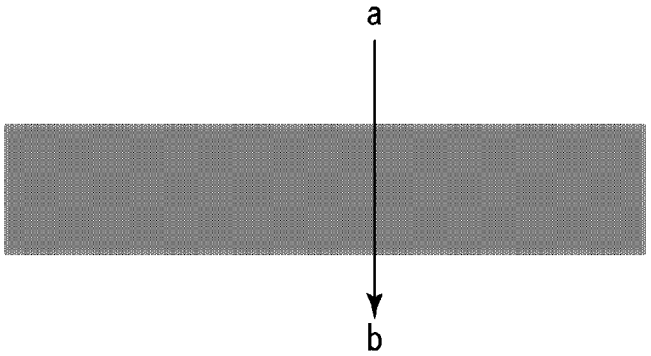

FIGS. 13A to 13C are diagrams showing an example to which the present invention is applied in a case where an edge portion is detected. In FIG. 13A, the pattern is printed in a direction of an arrow from a to b. In a case where the present invention is not applied to this pattern, density read values have a rounded edge because of the effects of the MTF as shown in FIG. 13B. Further, in a case where the ejection stoppage time is provided, printing is performed with the condensed ink at the side of a as shown in FIG. 13C. As a result, at the side of a, the optical density is high and the SN ratio improves, and the precision in detecting the edge can be improved.

In a method for heating the ink to a high temperature, a heat insulation material such as polyethylene resin having high thermal insulation efficiency may be used, or an air layer may be used as the heat insulation material by separating space. Further, a temperature control mechanism may be provided to actively heat the ink to a high temperature. In the case of controlling the temperature, the temperature is controlled to be high at least at the time of printing the pattern so that the ink does not condense much at the time of performing actual printing and the ink condenses much at the time of performing the pattern.

The ink having the low concentration of the coloring material has the effect of reducing granularity. However, in a case where the ink having the low concentration of the coloring material is condensed at the time of performing actual printing, the ink causes an increase in granularity. In this case, an increase in the concentration of the coloring material of the ink can be suppressed by randomly ejecting the ink on paper at a low density. Further, in a case where the pattern is printed, processing for reducing the concentration of the coloring material is stopped whereby the density of the pattern can be increased to exceed the threshold for detection by the scanner.

In the above examples, the pattern for detecting an ejection failure nozzle has been described. However, similar advantages can be achieved by applying the present invention to a detection pattern for detecting an accurate position for adjustment of a printing position and the like.

Further, in the above embodiments, explanation has been made on a combination of the liquid droplet ejection apparatus and the external scanner. However, it is possible to use a liquid droplet ejection apparatus having a scanner therein. Furthermore, in the above embodiments, the present invention is applied to an apparatus using full-line type print heads whose nozzles are arranged to correspond to the width of a printing medium to be conveyed. However, the present invention is not limited to these embodiments. The present invention can be applied to a serial printing apparatus which scans, across a printing medium, a print head having nozzles arranged therein and ejects an ink on the printing medium during the scanning to perform printing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-145605 filed Jul. 11, 2013, which is hereby incorporated by reference herein in its entirety.

What is claimed is:

1. An inkjet printing apparatus comprising:

a first print head in which a plurality of nozzles for ejecting a first type ink are arranged in an arranging direction;

a moving unit configured to move a printing medium with respect to the first print head in a moving direction crossing to the arranging direction; and an ejecting control unit configured to control ejecting the first type ink while moving of the printing medium by the moving unit so as to (i) eject the first type ink from a first number of the nozzles to print a first pattern to a first position of the printing medium in the moving direction, (ii) not eject the first type ink from the plurality of nozzles for a first period after the first pattern is printed, and (iii) eject the first type ink from a second number, which is larger than the first number, of the nozzles after the first period is elapsed, to print a second pattern to a second position of the printing medium which is positioned at upstream in the moving direction to the first position, wherein the temperature of the first type ink around the plurality of nozzles in the first period is 50° C. or more.

2. An inkjet printing apparatus according to claim 1, wherein the first period is 30 milliseconds or more.

3. An inkjet printing apparatus according to claim 1, further comprising a second print head in which a plurality of nozzles for ejecting a second type ink which is different from the first type ink are arranged in the arranging direction, wherein the ejecting control unit configured to control ejecting the second type ink while moving of the printing medium by the moving unit so as to (i) eject the second type ink from a third number of the nozzles to print a third pattern to a third position of the printing medium in the moving direction, (ii) not eject the second type ink from the plurality of nozzles for a second period after the third pattern is printed, and (iii) eject the second type ink from a fourth number, which is larger than the third number, of the nozzles after the second period is elapsed, to print a fourth pattern to a fourth position of the printing medium which is positioned at upstream in the moving direction to the third position, and the temperature of the second type ink in the plurality of nozzles in the second period is 50° C. or more and is higher than the temperature of the first type ink in the plurality of nozzles in the first period.

4. An inkjet printing apparatus according to claim 3, further comprising a reading unit configured to read the second pattern to obtain a reading signal value, wherein a reading signal value obtained by the reading unit for the second type ink is lower than a reading signal value obtained by the reading unit for the first type ink.

5. An inkjet printing apparatus according to claim 3, wherein a concentration of a color material in the second type ink is lower than a concentration of a color material in the first type ink.

6. An inkjet printing apparatus according to claim 3, wherein a size of a dot to be printed by ejecting the second type ink is smaller than a size of dot to be printed by ejecting the first type ink.

7. An inkjet printing apparatus according to claim 1, wherein the second pattern is a pattern for determining an ejection failure in the nozzle.

8. An inkjet printing apparatus according to claim 1, wherein the first pattern is a pattern for detecting a printed position of the second pattern.

9. An inkjet printing apparatus according to claim 1, further comprising a heating control unit configured to control heating of the first type ink.

10. An inkjet printing apparatus according to claim 9, further comprising a second print head in which a plurality of nozzles for ejecting a second type ink which is different from the first type ink are arranged in a arranging direction, wherein the ejecting control unit configured to control ejecting the second type ink while moving of the printing medium by the moving unit so as to (i) eject the second type ink from a third number of the nozzles to print a third pattern to a third position of the printing medium in the moving direction, (ii) not eject the second type ink from the plurality of nozzles in a second period after the third pattern is printed, and (iii) eject the second type ink from a fourth number, which is larger than the third number, of the nozzles after the second period is elapsed, to print a fourth pattern to a fourth position of the printing medium which is positioned at upstream in the moving direction to the third position, and the second period is 30 milliseconds or more and is longer than the first period.

11. An inkjet printing apparatus according to claim 10, further comprising a reading unit configured to read the second pattern to obtain a reading signal value, wherein a reading signal value obtained by the reading unit for the second type ink is lower than a reading signal value obtained by the reading unit for the first type ink.

12. An inkjet printing apparatus according to claim 10, wherein a concentration of a color material in the second type ink is lower than a concentration of a color material in the first type ink.

13. An inkjet printing apparatus according to claim 10, wherein a size of a dot to be printed by ejecting the second type ink is smaller than a size of dot to be printed by ejecting the first type ink.

14. A check pattern printing method comprising:

a moving step of moving a printing medium with respect to a print head, in which a plurality of nozzles for ejecting a first type ink are arranged in an arranging direction, in a moving direction crossing to the arranging direction; and an ejecting control step of controlling ejecting the first type ink while moving of the printing medium by the moving unit so as to (i) eject the first type ink from a first number of the nozzles to print a first pattern to a first position of the printing medium in the moving direction, (ii) not eject the first type ink from the plurality of nozzles for a first period after the first pattern is printed, and (iii) eject the first type ink from a second number, which is larger than the first number, of the nozzles after the first period is elapsed, to print a second pattern to a second position of the printing medium which is positioned at upstream in the moving direction to the first position, wherein the temperature of the first type ink around the plurality of nozzles in the first period is 50° C. or more.

15. A check pattern printing method using a first print head in which a plurality of nozzles for ejecting a first type ink are arranged in an arranging direction, the printing method comprising;

a moving step of moving a printing medium with respect to the first print head in a moving direction crossing to the arranging direction, and an ejecting control step of controlling ejecting the first type ink while moving of the printing medium by the moving unit so as to (i) eject the first type ink from a first number of the nozzles to print a first pattern to a first position of the printing medium in the moving direction, (ii) not eject the first type ink from the plurality of nozzles over a first period after the first pattern is printed, and (iii) eject the first type ink from a second number, which is larger than the first number, of the nozzles after the first period is elapsed, to print a second pattern to a second position of the printing medium which is positioned at upstream in the moving direction to the first position wherein the first period is 30 milliseconds or more.

16. An inkjet printing apparatus comprising:

a first print head in which a plurality of nozzles for ejecting a first type ink are arranged in an arranging direction;

a moving unit configured to move a printing medium with respect to the first print head to a moving direction crossing to the arranging direction, and an ejecting control unit configured to control ejecting the first type ink while moving of the printing medium by the moving unit so as to (i) eject the first type ink from a first number of the nozzles to print a first pattern to a first position of the printing medium in the moving direction, (ii) not eject the first type ink from the plurality of nozzles over a first period after the first pattern is printed, and (iii) eject the first type ink from a second number, which is larger than the first number, of the nozzles after the first period is elapsed, to print a second pattern to a second position of the printing medium which is positioned at upstream in the moving direction to the first position, wherein the first period is 30 milliseconds or more.

17. An inkjet printing apparatus according to claim 16, wherein the second pattern is a pattern for determining an ejection failure in the nozzle.

18. An inkjet printing apparatus according to claim 16, wherein the first pattern is a pattern for detecting a printing position.

19. An inkjet printing apparatus according to claim 16, further comprising a heating control unit configured to control heating of the first type ink.

* * * * *